US007997008B2

(12) United States Patent
Coomer

(10) Patent No.: US 7,997,008 B2
(45) Date of Patent: Aug. 16, 2011

(54) OVERSHOE FOR USE WHILE FINISHING CONCRETE

(76) Inventor: Rodney Coomer, Campbellsville, KY (US)

( * ) Notice: Subject to any disclaimer, the term of this patent is extended or adjusted under 35 U.S.C. 154(b) by 1008 days.

(21) Appl. No.: 11/843,026

(22) Filed: Aug. 22, 2007

(65) Prior Publication Data

US 2008/0178492 A1 Jul. 31, 2008

Related U.S. Application Data

(60) Provisional application No. 60/897,300, filed on Jan. 25, 2007.

(51) Int. Cl.
*A43B 3/20* (2006.01)
*A43B 1/10* (2006.01)

(52) U.S. Cl. ..... 36/7.5; 36/7.2; 36/7.4; 36/104

(58) Field of Classification Search ..... 36/7.1 R, 36/7.2–7.5, 104
See application file for complete search history.

(56) References Cited

U.S. PATENT DOCUMENTS 2,825,153 A * 3/1958 Fabrizio ..... 36/7.5
3,805,417 A 4/1974 Lobmeier et al.
4,742,625 A 5/1988 Sydor et al.
4,747,470 A 5/1988 Fernandez
4,972,610 A * 11/1990 Tong ..... 36/7.1 R
5,245,767 A 9/1993 Morin
5,469,644 A * 11/1995 Vidler ..... 36/127
5,638,614 A 6/1997 Hardy
5,884,419 A 3/1999 Davidowitz et al.
6,151,800 A 11/2000 Kerr et al.
6,298,583 B1 10/2001 Allen
6,516,538 B2 2/2003 Kraft
6,860,037 B1 3/2005 Norek
6,968,634 B2 * 11/2005 Dombowsky ..... 36/11.5
7,059,067 B2 6/2006 Geer et al.
7,204,044 B2 4/2007 Hoffer et al.
7,222,440 B2 5/2007 Dombowsky
7,222,442 B2 5/2007 Hillyer et al.
2005/0193596 A1 * 9/2005 Culton et al. ..... 36/135
2005/0268484 A1 * 12/2005 Dombowsky ..... 36/7.5

FOREIGN PATENT DOCUMENTS

JP 11 159148 A 6/1999
WO WO 2006/084185 A 8/2006

* cited by examiner

*Primary Examiner* — Mickey Yu
*Assistant Examiner* — Sharon M Prange
(74) *Attorney, Agent, or Firm* — Kilpatrick Townsend & Stockton LLP

(57) ABSTRACT

An overshoe used while finishing concrete and worn over another article of footwear. The overshoe includes a flexible and resilient sole and a substantially flat and smooth outsole, which is substantially resistant to adhering to wet concrete and abrasion resistant. The overshoe further includes a strap, which securely holds the overshoe onto a work boot.

13 Claims, 4 Drawing Sheets

OVERSHOE FOR USE WHILE FINISHING CONCRETE

CROSS-REFERENCE TO RELATED APPLICATIONS

Priority is hereby claimed to provisional application Ser. No. 60/897,300, filed Jan. 25, 2007, which is incorporated herein by reference.

FIELD OF INVENTION

This invention relates generally to an article of footwear designed to be worn over another shoe or boot and used while finishing concrete.

DESCRIPTION OF THE PRIOR ART

Concrete is one of the fundamental materials used in construction. This highly versatile mix of cement, aggregate, and water has become one of the most widely used manmade materials on the planet. Concrete is prized for its strength, durability, and workability. Because of its strength, concrete is used as the core structural support of many buildings. Once concrete has cured, it becomes impervious to many external factors such as water, temperature, chemicals, and other natural forces. Because concrete is immensely workable, it can also be used in decorative or aesthetic ways.

Large slabs of concrete are created by pouring a mixture of concrete into a mold or other form. Because concrete is liquid and flows, gravity will create a generally flat and horizontal top surface. The top surface of a poured concrete slab will likely dry with an uneven and irregular surface; therefore, additional work is required to finish and smooth the top layer of the concrete. The finishing procedure requires a worker to smooth out the top layer of concrete with powered or manual tools. For a relatively small slab of concrete, a worker can stand beside the slab and reach across the slab with the finishing tool. The process of finishing a large concrete slab requires the operator to walk across the concrete slab surface and use several different pieces of equipment or tools to smooth the slab surface as it sets. The concrete is considered to be in a "plastic state" after it has been poured when it is not exactly wet, but is not yet dry.

Walking on wet concrete presents an obvious problem. Standard shoes or work boots used by construction workers generally have an aggressively lugged tread. Furthermore, lugged treads often pick up dirt and other debris when worn on outdoor surfaces. The dirt and debris from the shoes is deposited onto the top of and into the concrete slab. Walking on a wet concrete slab with these shoes creates footprints and indentations and deposits debris into the surface of the concrete slab. Work boots can dig into the surface of the drying concrete causing scarring or other damaging marks. Thus, a worker must not only finish the irregular surface of the drying concrete but also repair the footprints that the worker left in the concrete. One alternative to walking upright on the concrete is kneeling on the concrete slab on a "kneeboard." The kneeboard is commonly a flat piece of stainless steel or fiberglass with the dimensions approximately 3 feet long and 1 foot wide. The size of the board spreads out the weight of the worker over a larger surface area and decreases the impression in the concrete. Although they spread out the weight, kneeboards made of stainless steel often become dented and bent and can imprint the concrete. Kneeboards made from fiberglass are porous and, along with stainless steel, stick to concrete. Furthermore, kneeling on the kneeboards causes pain and injury to the workers; standing upright while working on concrete is ergonomically preferred.

Wearing common work boots and shoes, while finishing a concrete slab, creates extra work for the concrete finishers. Therefore, a need exists for an article of footwear, which can be worn while standing and finishing concrete and not create surface flaws in the concrete slab.

SUMMARY

The present invention is directed to an article of footwear comprising a sole, a sidewall, a toe guard, and a strap. The sole has a perimeter and further comprises a substantially planar outsole, an insole, a midsole, a forefoot section, and a heel section. The sole is constructed from a material substantially resistant to adhering to wet concrete. The sidewall is attached substantially perpendicular to the perimeter of the sole. The sidewall further comprises two flanges, and each flange has an aperture defined therein. The toe guard is attached to the sidewall and is dimensioned and configured to cover the forefoot section of the sole. The strap comprises a first end and a second end dimensioned and configured to connect to each other. The strap is also dimensioned and configured to pass through the apertures in the flanges. The length of the strap is adjustable, and the first end of the strap and the second end of the strap are connected via a hook and loop buckle. The two flanges are located on opposing sides of the perimeter of the sole, and the apertures within the flanges are in substantial registration. The sole of the invention is comprised of a flexible and resilient material. The outsole is substantially flat and substantially smooth. The toe guard further contains at least one aperture dimensioned and configured to allow the passage of moisture and air.

The present invention is further directed to an article of footwear comprising a sole, a sidewall, a toe guard, and a strap. The sole has a perimeter and comprises an outsole, an insole, a midsole, a forefoot section, and a heel section. The outsole is substantially flat and smooth, and the sole is comprised of a substantially flexible and resilient material and is constructed from a material substantially resistant to adherence to wet concrete. The sidewall is attached substantially perpendicular to the perimeter of the sole. The sidewall further comprises two flanges, and each flange has an aperture defined therein. The toe guard is attached to the sidewall and dimensioned and configured to cover the forefoot section of the sole. The toe guard further comprises at least one aperture dimensioned and configured to allow the passage of moisture and air. The strap comprises a first end and a second end dimensioned and configured to connect to one another. The strap is dimensioned and configured to pass through the apertures and the flanges. The article of footwear is dimensioned and configured so that a second shoe can be placed on top of, and within, the perimeter of the insole. The toe guard covers the forefoot section of the second shoe, and the strap securely holds the second shoe in the article of footwear.

The present invention is further directed to an article of footwear comprising a sole, further comprising an insole and outsole, a forefoot section, a heel section, and two opposing lateral sides. The insole is dimensioned and configured to support and cradle a shoe, and the outsole is substantially flat and smooth. An upper is attached to the sole. The upper further comprises a toe guard, at least two flanges, and a perimeter sidewall. The toe guard is located at the forefoot section of the sole and defines a space between the insole and the toe guard. The at least two flanges are located on the two opposing lateral sides of the sole, and the at least two flanges have at least one aperture defined therein. The apertures are in substantial registration with one another. The perimeter rail is attached substantially perpendicular to the sole and is dimensioned and configured to wrap around the heel section of the sole. The strap comprises a first end and a second end and passes through the apertures in the at least two flanges. The first end and second end of the strap are dimensioned and configured to connect to each other. The first end and the second end define a length of the strap, which can be adjusted.

The present invention is an overshoe designed to be worn over a standard piece of footwear or, specifically, a work shoe. The overshoe is worn when a worker must walk on an end-process concrete slab. The substantially smooth and flat outsole of the overshoe spreads out the weight of the worker over a larger surface area of the concrete. This is especially advantageous compared to the traditional aggressively lugged outsoles of work shoes and boots. The flat outsole does not exert pressure on the concrete in a localized area and thus does not create divots or indentations in the concrete. Furthermore, the rounded edges of the outsole prevent the overshoe from putting creases or other lines in the wet concrete. Because the overshoe is made of a flexible and resilient material, the midsole and outsole can absorb localized pressure from the worker's shoe and spread the pressure across the surface of the outsole. This action further prevents localized pressure points between the outsole and the concrete. The flexibility of the overshoe allows for a rolling foot plant when the worker steps on the concrete. This rolling foot plant is advantageous over the stiffer construction of a typical work boot. The rolling foot plant also gradually introduces the pressure of the worker's weight onto the concrete and prevents acute impressions in the wet slab.

The overshoe is preferably made from a material which is substantially resistant to adherence to wet concrete and concrete in the plastic state. The preferred materials are ALCRYN® brand melt-processible rubber and DURAGRIP® brand melt-processible rubber. Both ALCRYN® brand melt-processible rubber and DURAGRIP® brand melt-processible rubber are available from Advanced Polymer Alloys, a division of Ferro Corporation, located in Wilmington, Del. ALCRYN® brand melt-processible rubber is non-hygroscopic and is very chemical resistant. ALCRYN® brand melt-processible rubber and DURAGRIP® brand melt-processible rubber are also abrasion resistant based on its tensile strength. The plastic state and finishing stage of concrete allow for the "cream" to rise to the top. This "cream" is typically very smooth, fluid, and sticky. The overshoe, made from adherence-resistant material, will not stick to the cream of the concrete. Therefore, when a worker walks across the concrete slab, he is less likely to leave footprints. In addition to the adherence resistance and flexibility of the overshoe material, it also is significantly abrasion resistant. This is advantageous because it extends the life of the overshoe in real world applications. The rough surface of cured concrete and asphalt wears down the soles of typical shoes and work boots. The overshoe's abrasion-resistant qualities help maintain the flat and smooth outsole for longer periods of time.

The design of the overshoe includes features designed for the comfort and safety of the worker. The elegant simplicity of the design makes the overshoe easy to put on. The large insole accommodates other shoes and work boots, which are typically large and bulky. A worker does not need to remove his work shoes to use the overshoe. The worker simply slips his work shoe onto the insole and underneath the toe guard. The toe space, between the toe guard and insole, is large enough to accommodate even the largest steel-toed work boots. The sidewall, which extends around the perimeter of the insole, keeps the worker's shoe in place on the insole. A simple strap mechanism securely holds the worker's shoe in place on the overshoe. The strap extends through the apertures in the lateral flanges and across the laces of the worker's shoe. The second end of the strap stretches around the back of the heel and attaches to the first end of the strap. A simple hook and loop type fastener securely holds the strap together. An adjustable buckle on the second end of the strap allows the effective length of the strap to be shortened and lengthened to accommodate the largest and smallest of feet. The toe guard has a plurality of holes, which provide for ventilation and water drainage. The sole of the overshoe is ergonomically beneficial to the worker because the sole is made from a flexible and resilient material. This feature reduces the stress on the worker's feet.

The objects and advantages of the invention will be illustrated more fully in the following detailed description of the preferred embodiment of the invention made in conjunction with the accompanying drawings.

DETAILED DESCRIPTION

Figure 1:
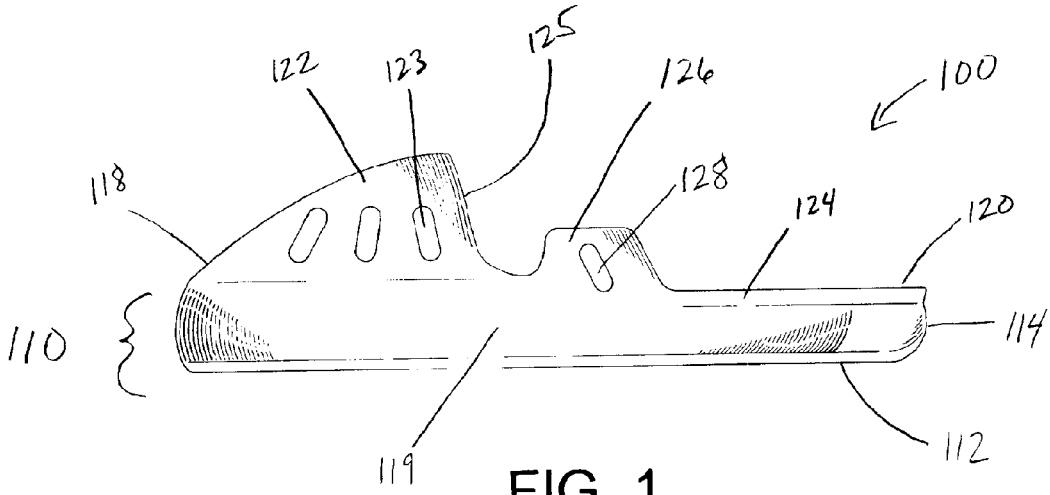
FIG. 1 is a side plan view of the overshoe.

Reference will now be made to the attached drawings, where the same reference numerals are used throughout the various views.

Referring to FIGS. 1-5, where the same reference numerals are used throughout the drawings, the invention is an overshoe 100. As shown in the figures, the overshoe 100 is dimensioned and configured to be worn over another type of footwear or shoe (hereinafter generically referred to as a work boot 200). For purposes of brevity only, the following description is limited to an overshoe 100 dimensioned and configured to carry such a work boot 200. The following description is limited to an overshoe 100 dimensioned and configured to be worn on wet concrete. However, the invention explicitly encompasses sizes, dimensions, and construction materials having the same claimed elements that are dimensioned and configured to be worn over other types of footwear and on other types of surfaces.

FIG. 1 is a side plan view of the overshoe 100. The overshoe 100 has a substantially flat and smooth outsole 112 dimensioned and configured to non-intrusively spread the weight of a worker across a wider area of a concrete slab. The flat and smooth outsole 112 is not predisposed to indenting or gouging a pre-cured concrete slab, or concrete in the plastic state. The overshoe 100 has a substantially flexible and resilient sole 110. The sole 110 is comprised of an outsole 112, a midsole 114, and an insole 116. The insole 116 is dimensioned and configured to accommodate work boot 200. The insole 116 is substantially slip resistant so that a work boot 200 will not slide across the insole 116 because of friction created. The midsole 114 is sandwiched between the outsole 112 and the insole 116. The midsole 114 is also substantially flexible and resilient in order to absorb shock or pressure on a worker's feet. In the preferred embodiment, the entire sole 110 of the overshoe 100 is constructed from ALCRYN® brand or DURAGRIP® brand melt-processible rubbers. However, it is within the scope of the invention that the three layers of the sole 110 are constructed of different materials. For example, the outsole 112 may be constructed of any material that is flexible and substantially resistant to adhering to concrete. Concrete is defined as any cement-based product including epoxy, stamped concrete, colored concrete, self-leveling concrete, lightweight concrete, etc. In another embodiment, the sole is resistant to adhering to mud or clay. The midsole 114 may be constructed of any material that is flexible and provides cushioning for the worker. The insole 116 can be made of any flexible material that may also give significant grip to the work boot 200. Additionally, the insole 116 may be coated with another slip-resistant material, such as sandpaper, to increase friction and grip between the work boot 200 and the insole 116. In yet another embodiment, the outsole can be adapted to include spikes used to walk on thin layers of lightweight concrete.

Figure 2:
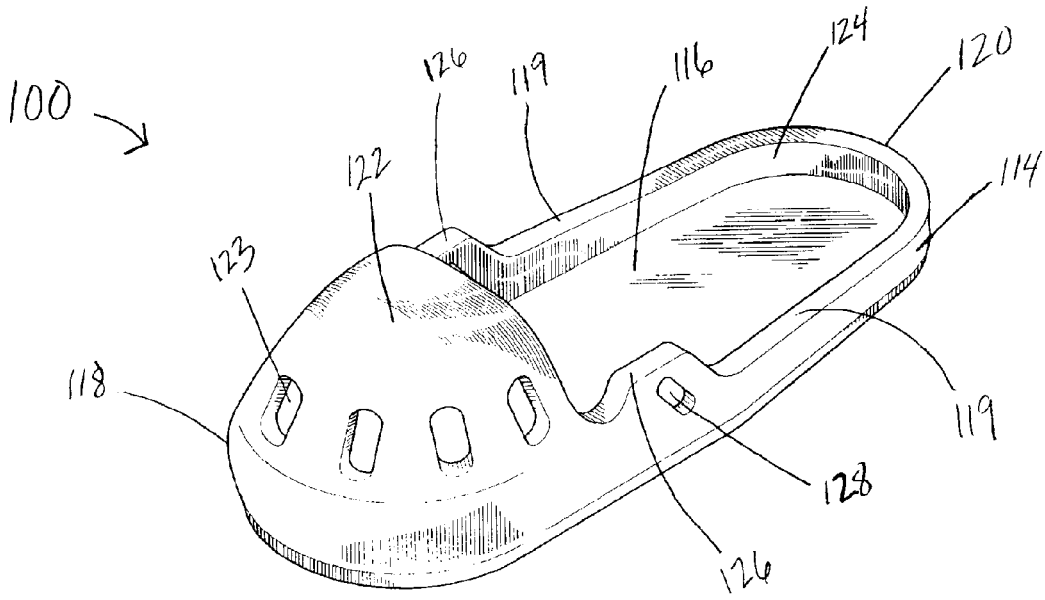
FIG. 2 is an upper perspective of the overshoe illustrating the insole and the toe guard.
Figure 3:
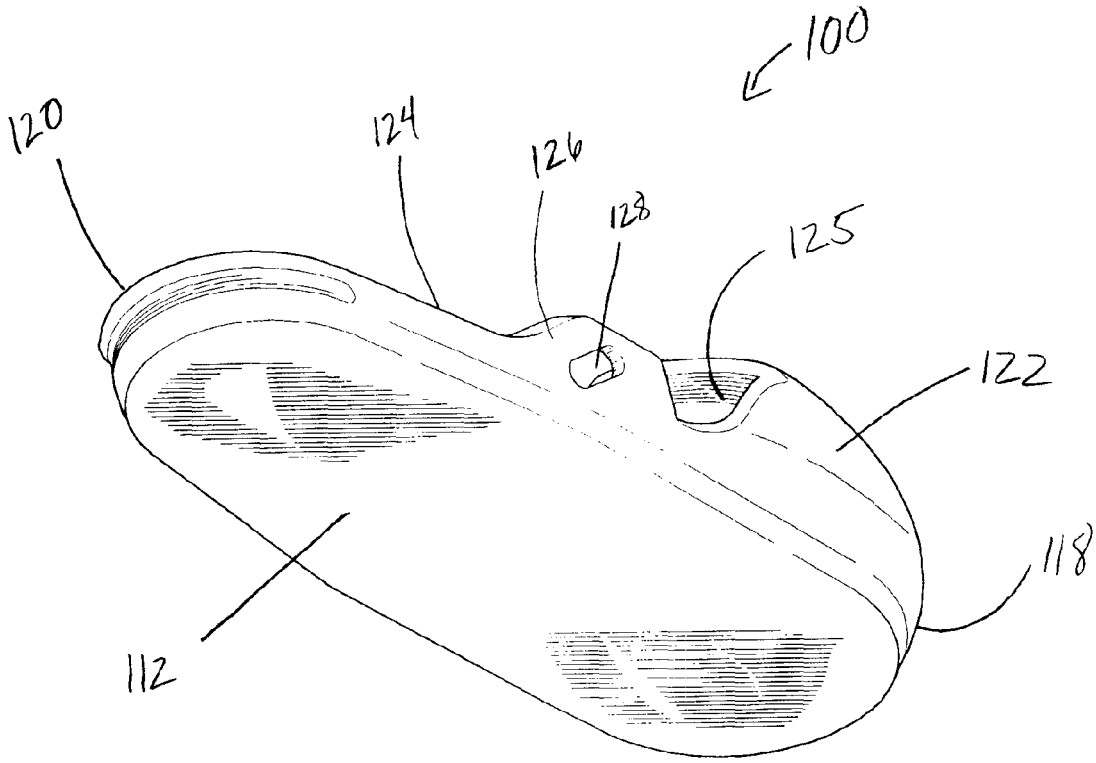
FIG. 3 is a lower perspective of the overshoe illustrating the smooth and flat outsole and the toe space.

As shown in FIGS. 1-3, the overshoe 100 has a forefoot section 118, two lateral sides 119, and a heel section 120. The heel section 120 may also include a concave indentation into the midsole 114 extending horizontally from one lateral side 119 to the other lateral side 119. A sidewall 124 wraps around the perimeter of the sole 110. The sidewall 124 extends approximately around the perimeter of the sole 110 from the forefoot section 118 along a lateral side 119 around the heel section 120 along the other lateral side 119 and ends back at the forefoot section 118. The sidewall 124 rises perpendicularly from the sole 110 to a height low enough to be easy to put on and a level high enough to prevent the work boot 200 from slipping off the insole 116. The toe guard 122 covers the forefoot section 118 of the sole 110. The distance between the toe guard 122 and the insole 116 defines the toe space 125. The toe space 125 is preferably large enough to accommodate a typical work boot 200. However, the toe guard 122 may also be made of ALCRYN® brand or DURAGRIP® brand melt-processible rubbers, which would make the toe guard 122 flexible. A flexible toe guard 122 can stretch and expand to accommodate unusually large work boots 200. The toe guard 122 also contains ventilation holes 123, which allow for the passage of air and moisture from the toe space 125.

Figure 4:
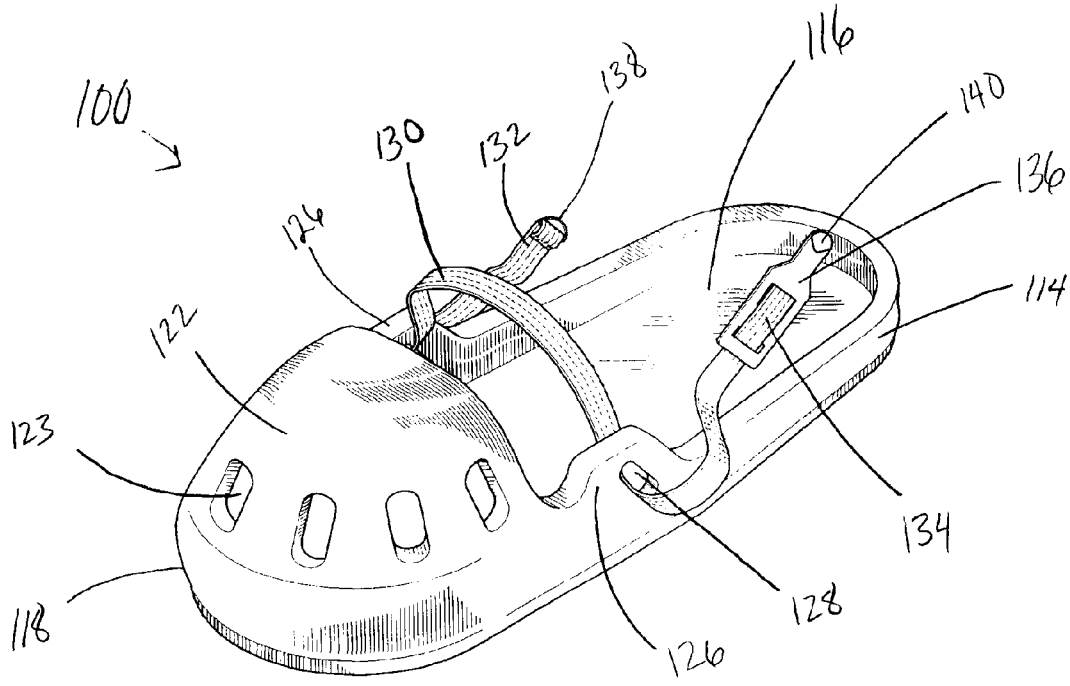
FIG. 4 is an upper perspective of the overshoe illustrating the strap and the apertures in the flanges through which it passes.
Figure 5:
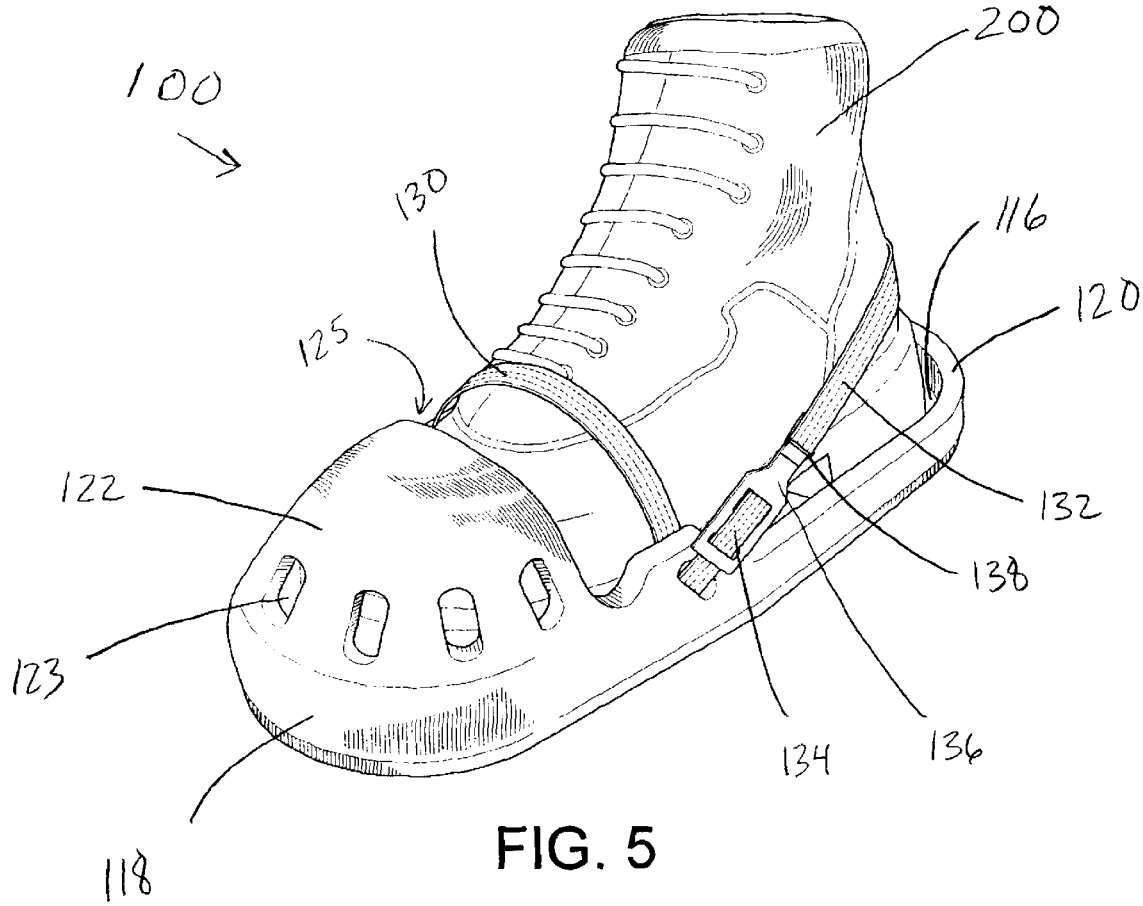
FIG. 5 is an illustration of a work boot inserted into the overshoe and held in place by the strap.

As shown in FIGS. 4 and 5, the overshoe 100 also includes two flanges 126 located on each of the lateral sides 119. Each of the flanges 126 is located above the sidewall 124 and between the forefoot section 118 and the heel section 120. Each flange 126 has an aperture 128. The apertures 128 are in substantial registration separated by the insole 116 of the overshoe 100. In FIG. 4, the strap 130 is illustrated passing through each of the apertures 128. The strap 130 is preferably made of a strong and elastic material. However, it may be made of any other substantially strong and flexible material. The strap 130 has a first end 132 and a second end 134. The strap 130 is dimensioned and configured so that the first end 132 and second end 134 can be securely attached to one another. In the preferred embodiment, the first end of the strap 130 includes a loop 138. The second end 134 preferably includes a buckle 136 with a hook 140. The buckle 136 is dimensioned and configured to slide along the strap 130 to effectively change the length of the strap 130. The hook 140 securely engages the loop 138 on the first end of the strap 130. Although the preferred embodiment includes a loop 138 and a hook 140, other means of fastening could include snaps, adhesive, or any other similar means.

FIG. 5 is an illustration of a work boot 200 securely engaged to the overshoe 100. The work boot 200 is resting on the insole 116 and between the heel section 120 and the forefoot section 118. The work boot 200 is also inserted into the toe space 125. The strap 130 secures the work boot 200 into the overshoe 100. The strap passes through the apertures 128, across the work boot 200 through the opposite aperture 128, and around the back of the work boot 200. The first end 132 and the second end 134 are brought together so that the loop 138 and hook 140 can engage. The buckle 136 can be slid along the second end 134 of the strap 130 to shorten the length of the strap 130.

In summary, the design features of the overshoe 100 are designed for the comfort of the worker and the protection of the concrete slab. The outsole 112 is substantially wider than the average work boot 200 and is substantially flat and smooth. The low sidewall 124 and the strap 130 make the overshoe 100 easy to put on and use. The flexibility and resiliency of the sole 110 provide for a cushioned foot plant for the worker and pressure distribution to protect the concrete.

It is understood that the invention is not confined to the particular construction and arrangement of parts herein illustrated and described but embraces such modified forms thereof as come within the scope of the following claims. Thus, the invention encompasses all different versions that fall literally or equivalently within the scope of the claims.

I claim:

1. An article of footwear comprising:

a sole having a perimeter, wherein the sole comprises:

a substantially planar outsole including a rounded side-view edge throughout a perimeter of the outsole, an insole, a midsole, a forefoot section, a heel section, and wherein the sole is constructed from a non-hygroscopic melt processible rubber material substantially resistant to adhering to wet concrete;

a side wall attached substantially perpendicular to the perimeter of the sole, wherein the side wall further comprises two flanges and wherein each flange has an aperture defined therein;

a toe guard attached to the side wall and dimensioned and configured to cover the forefoot section of the sole; and a strap, wherein the strap comprises a first end and a second end dimensioned and configured to connect to each other and wherein the strap is dimensioned and configured to pass through the apertures in the flanges, wherein the strap is configured to secure around a top and a rear of a wearer's foot and is passed through only two apertures of the article of footwear, and wherein the strap comprises a continuous length of material that, when the first and second ends are connected, traverses the top and the rear of the wearer's foot.

2. The article of footwear of claim 1, wherein the two flanges are located on opposing sides of the perimeter of the sole and wherein the apertures in the flanges are in substantial registration.

3. The article of footwear of claim 1, wherein the outsole is substantially flat.

4. The article of footwear of claim 1, wherein the outsole is substantially smooth.

5. The article of footwear of claim 1, wherein the sole is comprised of a flexible and resilient material.

6. The article of footwear of claim 1, wherein the strap includes an adjustable length.

7. The article of footwear of claim 1, wherein the first end of the strap and the second end of the strap are connected via a hook and loop buckle.

8. The article of footwear of claim 1, wherein the toe guard further contains at least one aperture, dimensioned and configured to allow the passage of moisture and air.

9. An article of footwear comprising:

a sole having a perimeter, wherein the sole comprises:

an outsole, wherein the outsole is substantially flat and smooth and includes a rounded side-view edge throughout a perimeter of the outsole, an insole, a midsole, a forefoot section, a heel section, and wherein the sole is comprised of a substantially flexible and resilient material and wherein the sole is constructed from a non-hygroscopic melt processible rubber material substantially resistant to adhering to wet concrete;

a side wall attached substantially perpendicular to the perimeter of the sole, wherein the side wall further comprises two flanges and wherein each flange has an aperture defined therein;

a toe guard attached to the side wall and dimensioned and configured to cover the forefoot section of the sole, wherein the toe guard further comprises at least one aperture, dimensioned and configured to allow the passage of moisture and air; and a strap, wherein the strap comprises a first end and a second end dimensioned and configured to connect to each another and wherein the strap is dimensioned and configured to pass through the apertures in the flanges;

wherein the article of footwear is dimensioned and configured so that a second shoe can be placed on top of and within the perimeter of the insole and wherein the toe guard covers the forefoot section of the second shoe and wherein the strap securely holds the second shoe to the article of footwear, wherein the strap is configured to secure around a top and a rear of a wearer's foot and is passed through only two apertures of the article of footwear, and wherein the strap comprises a continuous length of material that, when the first and second ends are connected, traverses the top and the rear of the wearer's foot.

10. The article of footwear of claim 9, wherein the two flanges are located on opposing sides of the perimeter of the sole and wherein the apertures in the flanges are in substantial registration.

11. The article of footwear of claim 9, wherein the strap includes an adjustable length.

12. The article of footwear of claim 9, wherein the first end of the strap and the second end of the strap are connected via a hook and loop buckle.

13. An article of footwear comprising:

a sole, further comprising an insole, an outsole, a forefoot section, a heel section, and two opposing lateral sides, wherein the insole is dimensioned and configured to support and cradle a shoe and wherein the outsole is substantially flat and smooth and includes a rounded side-view edge throughout a perimeter of the outsole;

an upper attached to the sole, the upper further comprising a toe guard, at least two flanges, and a perimeter side wall, wherein the toe guard is located at the forefoot section of the sole and defining a space between the insole and the toe guard, wherein the at least two flanges are located on the two opposing lateral sides of the sole and wherein each of the at least two flanges have at least one aperture defined therein and wherein the apertures are in registration, wherein the perimeter side wall is attached substantially perpendicular to the sole and is dimensioned and configured to wrap around the heel section of the sole; and a strap comprising a first end and a second end, wherein the strap passes through the apertures in the at least two flanges and wherein the first end and second end are dimensioned and configured to connect to each other and wherein the first end and the second end define a length of the strap and wherein the length of the strap is adjustable;

wherein at least the outsole is constructed of a flexible and resilient non-hygroscopic melt processible rubber material and is substantially resistant to adhering to wet concrete, wherein the strap is configured to secure around a top and a rear of a wearer's foot and is passed through only two apertures of the article of footwear, and wherein the strap comprises a continuous length of material that, when the first and second ends are connected, traverses the top and the rear of the wearer's foot.

* * * * *